US011400571B2

(12) United States Patent
Goto

(10) Patent No.: US 11,400,571 B2
(45) Date of Patent: Aug. 2, 2022

(54) TONGUE BREAK-OFF TOOL AND TONGUE BREAK-OFF METHOD

(71) Applicant: Sanyu Seiki Corporation, Tokyo (JP)

(72) Inventor: Tamaki Goto, Tokyo (JP)

(73) Assignee: SANYU SEIKI CORPORATION, Tokyo (JP)

( * ) Notice: Subject to any disclaimer, the term of this patent is extended or adjusted under 35 U.S.C. 154(b) by 0 days.

(21) Appl. No.: 17/438,240

(22) PCT Filed: Aug. 30, 2019

(86) PCT No.: PCT/JP2019/034222
§ 371 (c)(1),
(2) Date: Sep. 10, 2021

(87) PCT Pub. No.: WO2020/246049
PCT Pub. Date: Dec. 10, 2020

(65) Prior Publication Data

US 2022/0080568 A1 Mar. 17, 2022

(30) Foreign Application Priority Data

Jun. 4, 2019 (JP) ..... JP2019-104356

(51) Int. Cl.
*B25B 27/14* (2006.01)

(52) U.S. Cl.
CPC ..... *B25B 27/143* (2013.01)

(58) Field of Classification Search
CPC ..... B25B 27/143; B25B 27/14; B25B 27/146; B25B 27/16; B25B 27/18; B25B 27/20;
(Continued)

(56) References Cited

U.S. PATENT DOCUMENTS 2,314,760 A * 3/1943 Blair ..... B23P 19/006 81/57.3
2,584,118 A * 2/1952 Forster ..... B25B 27/143 29/240.5

(Continued)

FOREIGN PATENT DOCUMENTS

CA 2 295 258 A1 2/2001
JP H07-108429 A 4/1995

(Continued)

OTHER PUBLICATIONS

Written Opinion of the International Search Authority (WO/ISA) in PCT/JP2019/034222, dated Nov. 19, 2019, with its English translation, 6 pgs.

(Continued)

*Primary Examiner* — Robert J Scruggs
(74) *Attorney, Agent, or Firm* — Young Basile Hanlon & MacFarlane, P.C.

(57) ABSTRACT

A tongue break-off tool includes a hook member configured to have a hook hooked onto a tongue of an insert with a tongue that is inserted into a tap hole, a moving member configured to move the hook member in a diagonal direction diagonally intersecting an extending direction of the tap hole from a far side to a near side of the tap hole to break off the tongue from the insert with a tongue, and a holding member configured to hold the tongue broken off from the insert with a tongue.

20 Claims, 5 Drawing Sheets

(58) Field of Classification Search
CPC ..... B25B 27/24; B25B 27/28; B25B 27/30; B25B 27/302; B25B 27/304; B25B 27/306; B25B 27/308; B23P 19/04; B21C 37/15; B21H 3/00; B21J 15/50
See application file for complete search history.

(56) References Cited

U.S. PATENT DOCUMENTS

| | | | | |
|---|---|---|---|---|
| 4,768,270 | A * | 9/1988 | Czarnowski | B25B 27/143 29/227 |
| 5,172,842 | A | 12/1992 | Viscio et al. | |
| 6,421,899 | B1 | 7/2002 | Zitnay | |
| 2009/0158569 | A1 * | 6/2009 | Yui | B25B 27/143 29/240.5 |

FOREIGN PATENT DOCUMENTS

| | | | |
|---|---|---|---|
| JP | H11-156751 | A | 6/1999 |
| JP | 2000-317857 | A | 11/2000 |
| JP | 2001-150363 | A | 6/2001 |
| JP | 2005-238376 | A | 9/2005 |
| JP | 2007-326162 | A | 12/2007 |
| JP | 5639443 | B2 | 12/2014 |
| WO | 01/014105 | A1 | 3/2001 |

OTHER PUBLICATIONS

European Search Report for corresponding Application No. 19932003.7, dated May 18, 2022, 8 pgs.

* cited by examiner

TONGUE BREAK-OFF TOOL AND TONGUE BREAK-OFF METHOD

TECHNICAL FIELD

The present invention relates to a tongue break-off tool and a tongue break-off method.

BACKGROUND

Usually, when a strong female screw is required, such as when the durability of the female screw is required or when strong tightening is required, an insert called a coil insert or a screw insert is used, for example. The insert is formed by winding a wire rod such as stainless steel in a coil shape, which is inserted (embedded) while being screwed into a tap hole (screw hole) of a workpiece such as resin or aluminum alloy by an insert insertion tool. A tongue bent in the radial direction of the coil is formed at the end portion of the insert. When inserting this insert with a tongue into the tap hole, the user uses the insert insertion tool to pinch the tongue with the tip end portion of the insert insertion tool or to hook the tip end portion of the insert insertion tool to the tongue and rotate the insert through the tongue to screw the insert into the tap hole.

The tongue is used when the insert is inserted into the tap hole, and becomes unnecessary after the insert is inserted. Therefore, a notch for breaking off the tongue is formed around the root of the tongue. After inserting the insert into the tap hole, the user puts a pin such as a steel rod on the tongue and hits the head of the pin with a hammer to break off the tongue (break-off work). Because the tongue broken off from the insert remains in the tap hole, the user collects the tongue from the tap hole using a tool such as tweezers (collection work). In this manner, it is necessary to perform both the break-off work and the collection work, and the work is interrupted by the tool replacement during the work. Thus, work efficiency is lowered.

An example of the above is shown in JP Patent Publication No. 11-156751 A.

BRIEF SUMMARY

An object to be solved by the present invention is to provide a tongue break-off tool and a tongue break-off method capable of improving work efficiency.

According to an embodiment of the present invention, a tongue break-off tool includes a hook member configured to have a hook hooked onto a tongue of an insert with a tongue that is inserted into a tap hole, a moving member configured to move the hook member in a diagonal direction diagonally intersecting an extending direction of the tap hole from a far side to a near side of the tap hole to break off the tongue from the insert with a tongue, and a holding member configured to hold the tongue broken off from the insert with a tongue.

In the tongue break-off tool, the moving member may move the hook member such that the hook is hooked onto the tongue to pull up the tongue in the diagonal direction, and the tongue is broken off from the insert with a tongue.

In the tongue break-off tool, the hook may have a hooking surface that is hooked onto the tongue, and may be formed to be hooked onto the tongue in a state where a longitudinal direction of the hooking surface is along an extending direction of the tongue.

In the tongue break-off tool, the holding member may be provided to be in contact with the tongue in a state where the hook is hooked onto the tongue.

In the tongue break-off tool, a guide member configured to guide the hook to the tongue such that the hook is hooked onto the tongue may further be provided.

In the tongue break-off tool, the guide member may be provided on the hook member and may form a storage space into which the tongue enters in cooperation with the hook member.

In the tongue break-off tool, the guide member may be an elastically deformable plate spring, and the plate spring may elastically deform by coming into contact with the tongue that enters the storage space.

In the tongue break-off tool, the moving member may include a plier that moves the hook member, and a regulation member that determines a separation distance between the plier and the tap hole.

In the tongue break-off tool, the plier may have a first stay and a second stay, and the hook member may move in the diagonal direction by the first stay. The hook member may include a first through-hole through which the first stay passes and having a size that makes it possible for the hook member to move along the first stay, and a second through-hole through which the second stay passes and having a size that makes it possible for the hook member to move without being hindered by the second stay.

According to another embodiment of the present invention, a tongue break-off method includes hooking a hook of a hook member included in a tongue break-off tool onto a tongue of an insert with a tongue that is inserted into a tap hole, moving the hook member in a diagonal direction diagonally intersecting an extending direction of the tap hole from a far side to a near side of the tap hole to break off the tongue from the insert with a tongue, by a moving member included in the tongue break-off tool, and holding the tongue broken off from the insert with a tongue by a holding member included in the tongue break-off tool.

According to the embodiments of the present invention, it is possible to improve work efficiency.

DETAILED DESCRIPTION

First Embodiment

One embodiment will be described with reference to the drawings. The up-down and left-right directions in the embodiment are based on the drawings.

Basic Configuration

Figure 1:
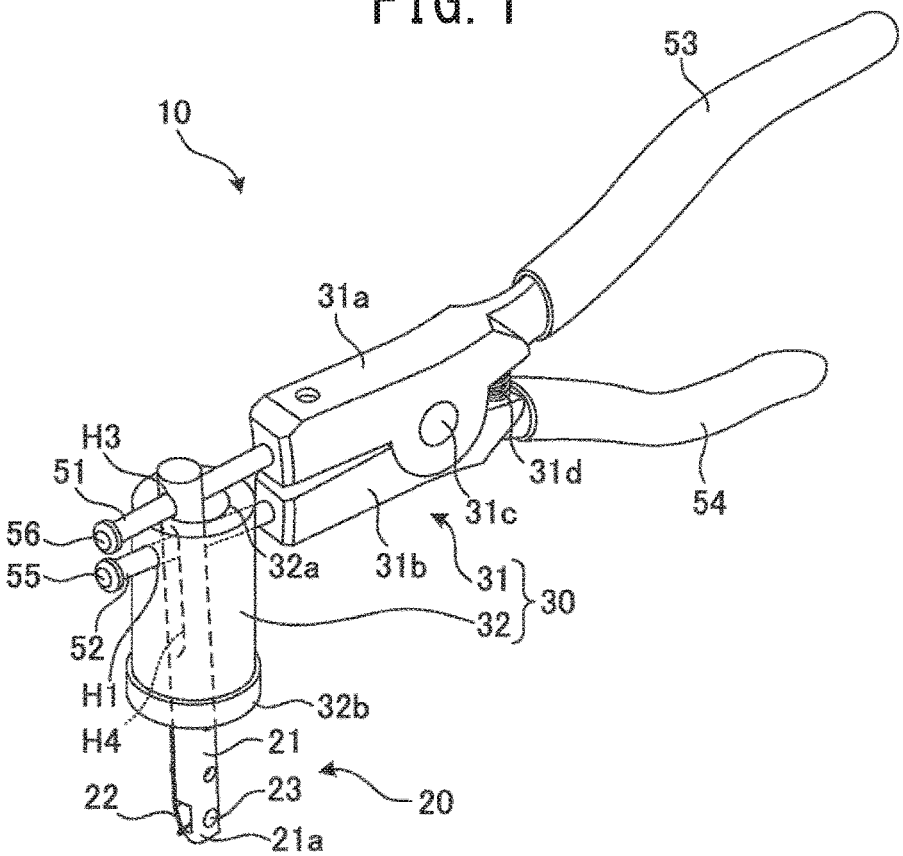
FIG. 1 is a perspective view illustrating a tongue break-off tool according to an embodiment.
Figure 2:
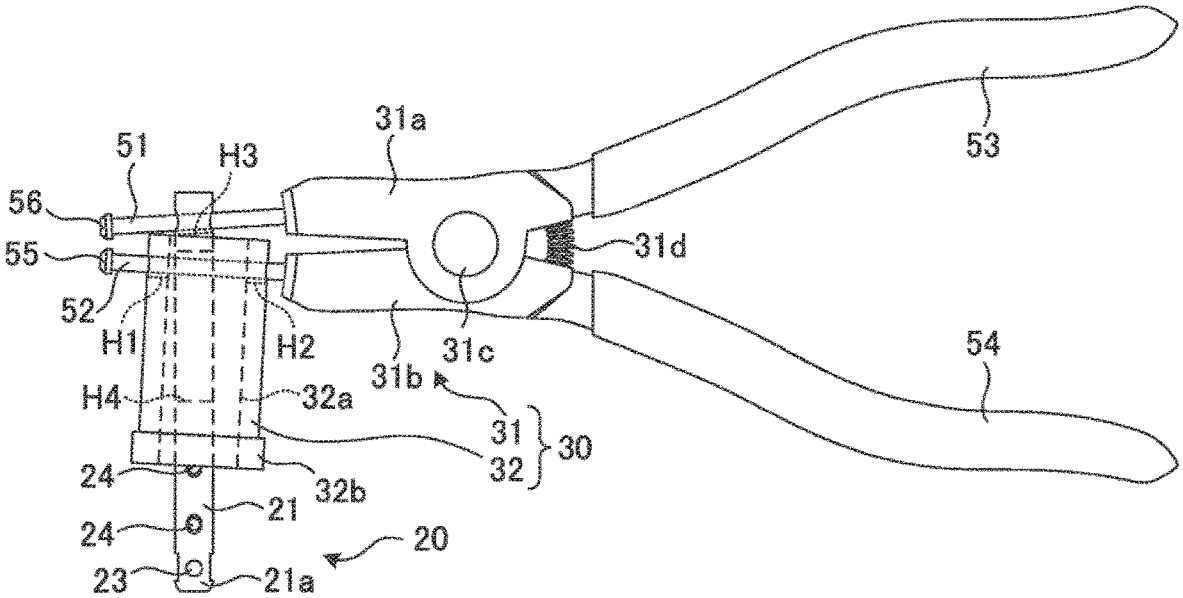
FIG. 2 is a front view illustrating the tongue break-off tool according to the embodiment.
Figure 3:
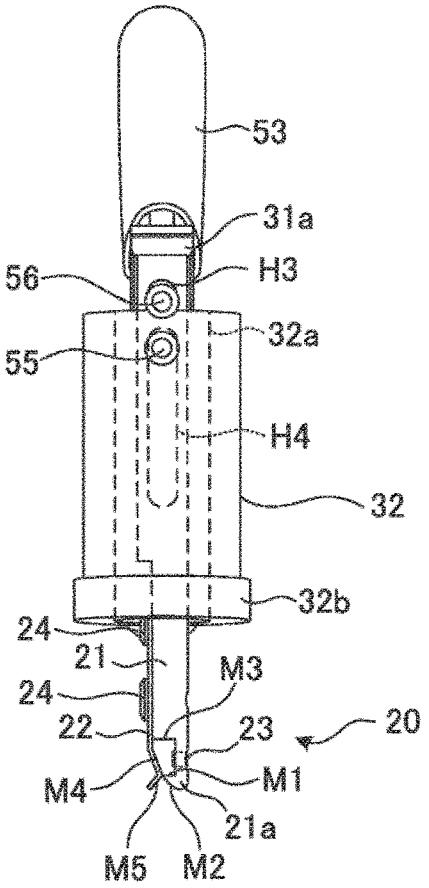
FIG. 3 is a left side view illustrating the tongue break-off tool according to the embodiment.

As illustrated in FIGS. 1 to 3, a tongue break-off tool 10 according to an embodiment includes an insertion member 20 and a moving member 30. The tongue break-off tool 10 is used for breaking off and collecting a tongue B2 from an insert with a tongue B1 (hereinafter, referred to as insert B1) that is inserted (embedded) into a tap hole A2 of a workpiece A1 illustrated in FIG. 4.

The insertion member 20 includes a hook member 21, a guide member 22 (refer to FIGS. 1 and 3), and a holding member 23. The insertion member 20 is inserted into the insert B1 inserted into the tap hole A2 of the workpiece A1.

The hook member 21 is formed in a columnar shape, and a hook (hooking unit) 21*a* is formed at an end portion of the hook member 21 on the lower end side. The hook 21*a* is formed in an L shape to be hooked onto the tongue B2 of the insert B1 inserted into the tap hole A2. As illustrated in FIG. 3, the hook 21*a* has a hooking surface M1 and an inclined surface M2. The hooking surface M1 is a substantially rectangular flat surface orthogonal to the extending direction of the hook member 21. The inclined surface M2 is a substantially rectangular flat surface that is inclined at an acute angle with respect to the hooking surface M1. The hook member 21 has an abutting surface M3 as illustrated in FIG. 3. The abutting surface M3 is a substantially rectangular flat surface orthogonal to the extending direction of the hook member 21, and faces the hooking surface M1. As illustrated in FIGS. 1 and 2, the hook member 21 is connected to a part of the moving member 30, and is configured to be movable upward by the moving member 30 (details will be described later).

As illustrated in FIGS. 1 and 3, the guide member 22 is formed in a plate shape, and is provided on the hook member 21 such that the end portion of the guide member 22 on the lower end side faces the hook 21*a* and a storage space into which the tongue B2 enters is formed in cooperation with the hook member 21. As illustrated in FIGS. 2 and 3, the guide member 22 is fixed to the hook member 21 by, for example, two fixing members 24. As the guide member 22, for example, an elastically deformable plate spring is used. As the fixing member 24, for example, bolts or screws are used. As illustrated in FIG. 3, a tip end portion of the guide member 22 is formed in a V shape that protrudes and bends toward the hook 21*a* side, and has two inclined surfaces M4 and M5. These inclined surfaces M4 and M5 are flat surfaces that are inclined so as to be away from each other from the V-shaped bent part. The height position of the bent part is the same height position as the hooking surface M1 of the hook 21*a*. The guide member 22 comes into contact with the tongue B2 of the insert B1 inserted into the tap hole A2 in response to the upward movement of the hook member 21, and guides the hooking surface M1 of the hook 21*a* directly below the tongue B2 (details will be described later).

Here, the insertion member 20 is inserted into the tap hole A2 from the hook 21*a* side and moves to the far part of the tap hole A2. At this time, even when the guide member 22 abuts against the tongue B2, the tongue B2 is not broken off. The plate shape of the guide member 22 has a predetermined thickness of, for example, approximately 1 mm to come into contact with the tongue B2 that enters the storage space to be elastically deformed. Therefore, even when the guide member 22 abuts against the tongue B2, the tongue B2 is avoided without being broken off, and the tongue B2 enters the storage space, which is a space between the guide member 22 and the hook member 21. The bent part of the guide member 22 and the tip end part of the hook 21*a* of the hook member 21 are in contact with each other, and this part serves as an entrance to the storage space.

As illustrated in FIGS. 1 and 3, the holding member 23 is positioned in the vicinity of a location against which the tongue B2 abuts in the hook 21*a*, for example, in the vicinity of the hooking surface M1 of the hook 21*a*. The holding member 23 is also provided inside the extended part of the hook 21*a*. Both end surfaces of the holding member 23 are exposed from the surface of the hook 21*a*, and hold the tongue B2 broken off from the insert B1 inserted into the tap hole A2. As the holding member 23, for example, a magnet (for example, a permanent magnet) that attracts the tongue B2 is used.

As illustrated in FIGS. 1 and 2, the moving member 30 has a plier 31 and a regulation member 32. When the tongue B2 is broken off from the insert B1 inserted into the tap hole A2, the moving member 30 moves the hook member 21 by the plier 31 in the direction diagonally intersecting the extending direction of the tap hole A2 from the far side to the near side (from lower side to upper side) of the tap hole A2, that is, the diagonal direction (details will be described later).

The plier 31 has a first stay 31*a* and a second stay 31*b*. The first stay 31*a* and the second stay 31*b* have a plier structure in which the first stay 31*a* and the second stay 31*b* are coupled to each other by a pivot (rotation axis) 31*c* such that the end portions approach or separate from each other, and the end portions are capable of freely opening and closing. Each of the end portions (tip end portions 51 and 52) of the first stay 31*a* and the second stay 31*b* is formed in a rod shape, and each of the other end portions (rear end portions 53 and 54) is formed to be a grip unit held by the user. The first stay 31*a* and the second stay 31*b* are biased by a biasing member 31*d* in the direction in which the tip end portions 51 and 52 approach each other (closing direction). As the biasing member 31*d*, for example, a spring such as a coil spring is used.

The regulation member 32 is formed in a cylindrical shape (sleeve shape) and has a storage hole 32*a*, which is a through-hole. The storage hole 32*a* is formed in a size that makes it possible for the hook member 21 to move and be accommodated. The regulation member 32 has a guard 32*b*. The guard 32*b* is formed in an annular shape and is provided at the lower end of the regulation member 32. The guard 32*b* functions as a cushioning material that cushions the impact when the regulation member 32 abuts against the surface of the workpiece A1. As the guard 32*b*, for example, a resin material is used. When the tongue B2 is broken off from the insert B1 inserted into the tap hole A2, the regulation member 32 abuts against the surface of the workpiece A1 via the guard 32*b*. The separation distance between the tap hole A2 and the plier 31, that is, the separation distance (for example, vertical separation distance) between the surface of the workpiece A1 and the plier 31 is determined (details will be described later).

The regulation member 32 is provided at the tip end portion 52 to be movable along the extending direction of the tip end portion 52 of the second stay 31*b*. As illustrated in FIG. 2, the regulation member 32 has a first through-hole H1 and a second through-hole H2. The first through-hole H1 and the second through-hole H2 are positioned on the upper end side of the regulation member 32 and at positions facing each other, and are formed on the circumferential surface (circumferential wall) of the regulation member 32. The first through-hole H1 and the second through-hole H2 are through-holes through which the tip end portion 52 of the second stay 31*b* passes, and are formed to have sizes that make it possible for the regulation member 32 to move along the tip end portion 52.

The above-described hook member 21 is provided at the tip end portion 51 to pass through the storage hole 32*a* of the regulation member 32 and be movable along the extending direction of the tip end portion 51 of the first stay 31*a*. The hook member 21 has a first through-hole H3 and a second through-hole H4. The first through-hole H3 is formed on the upper end side of the hook member 21. The first through-hole H3 is a through-hole through which the tip end portion 51 of the first stay 31*a* passes, and is formed to have a size that makes it possible for the hook member 21 to move along the tip end portion 51. The second through-hole H4 is formed in the vicinity of the center of the hook member 21. The second through-hole H4 is a through-hole through which the tip end portion 52 of the second stay 31*b* passes, and is formed to have a size that makes it possible for the hook member 21 to move without being hindered by the tip end portion 52 (e.g., a size in which the hook member 21 and the tip end portion 52 of the second stay 31*b* do not abut against each other).

Here, the tip end portion 51 of the first stay 31*a* passes through the first through-hole H3 of the hook member 21. The hook member 21 is movable along the extending direction of the tip end portion 51 of the first stay 31*a*, and moves upward (specifically, in a diagonal direction) by moving the tip end portion 51 upward. The tip end portion 52 of the second stay 31*b* passes through the first through-hole H1 of the regulation member 32, the second through-hole H4 of the hook member 21, and the second through-hole H2 of the regulation member 32. The regulation member 32 is movable along the extending direction of the tip end portion 52 of the second stay 31*b*, and is moved downward by moving the tip end portion 52 downward.

A return unit 55 is provided at the tip end of the tip end portion 52 of the second stay 31*b* such that the regulation member 32 does not come off from the tip end portion 52. The return unit 55 is formed to be detachably attached to the tip end portion 52 of the second stay 31*b*. Similarly, the tip end portion 51 of the first stay 31*a* is also provided with a return unit 56, and the return unit 56 is formed to be detachably attached to the tip end portion 51. However, when there is the return unit 55, the return unit 56 may be omitted.

Tongue Break-Off Operation

Figure 5:
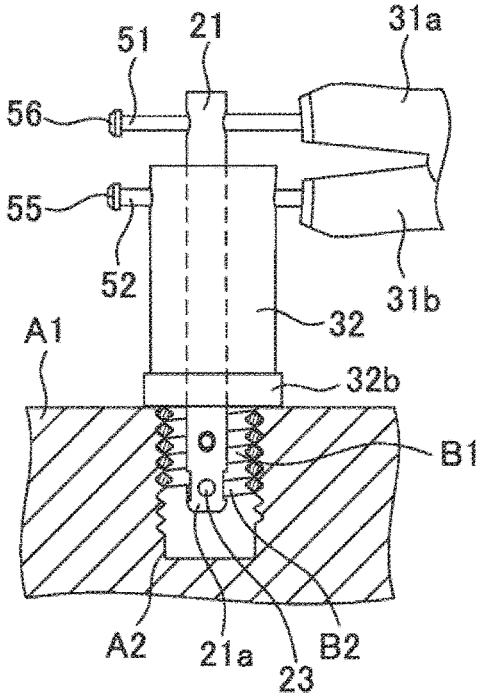
FIG. 5 is a second view for describing the tongue break-off operation according to the embodiment.
Figure 6:
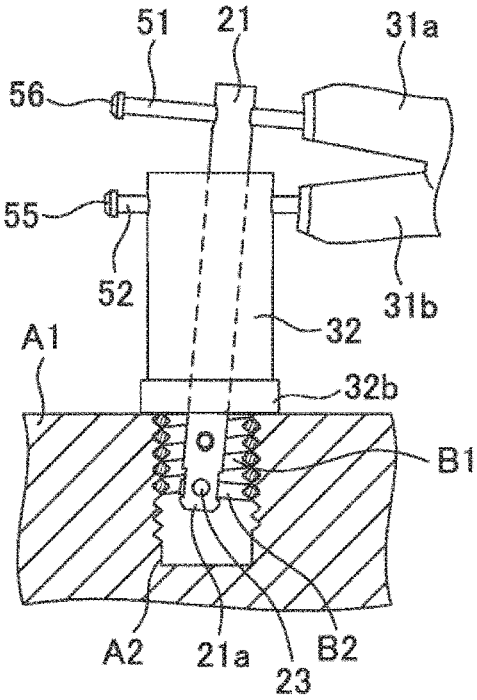
FIG. 6 is a third view for describing the tongue break-off operation according to the embodiment.
Figure 7:
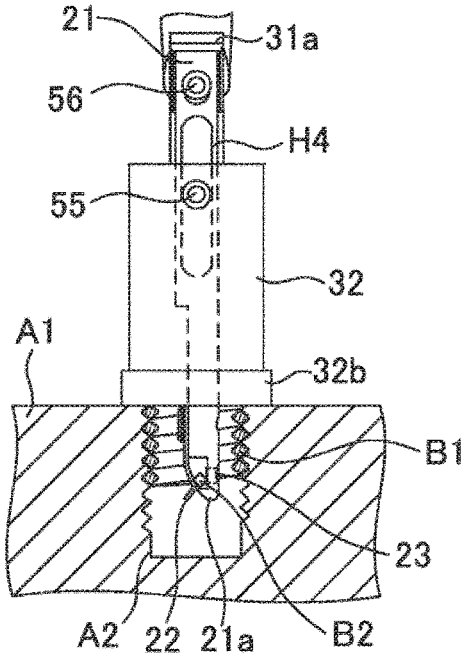
FIG. 7 is a fourth view for describing the tongue break-off operation according to the embodiment.
Figure 8:
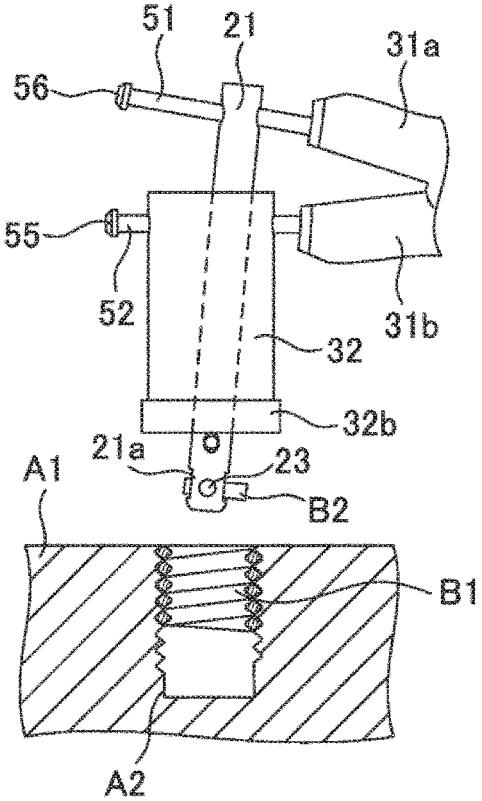
FIG. 8 is a fifth view for describing the tongue break-off operation according to the embodiment.
Figure 9:
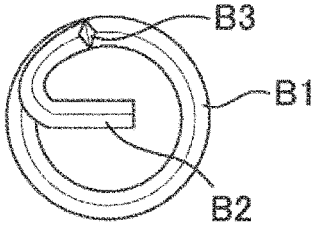
FIG. 9 is a view for describing a notch of an insert according to the embodiment.

Next, a tongue break-off operation using the above-described tongue break-off tool 10 will be described with reference to FIGS. 4 to 9. In FIGS. 4 to 8, a workpiece A1, a tap hole A2, and an insert B1 are illustrated in a cross section. FIG. 7 illustrates a state similar to that of FIG. 6 from a direction different from that of FIG. 6. In FIG. 9, the end surface on the lower end side of the insert B1 (the end surface on the side of the insert B1 that is first inserted into the tap hole A2) is illustrated.

As illustrated in FIGS. 4 to 8, the insert B1 is formed by winding a wire rod having a rhombic cross section (for example, a metal such as stainless steel) in a coil shape. The outer circumferential surface of the insert B1 functions as an outer thread, and the inner circumferential surface of the insert B1 functions as an inner thread. As illustrated in FIGS. 4 to 9, the tongue B2 bent in the radial direction of the coil is formed at one end portion of the insert B1. As illustrated in FIG. 9, a notch B3 for breaking off the tongue is formed around the root of the tongue B2 in the insert B1. The notch B3 is formed in the insert B1 such that a small piece of the tongue B2 broken off from the insert B1 has a "re" shape (V shape). The notch B3 is formed such that a rotation angle around the axis of the coil is within a range of, for example, 10 degrees to 90 degrees (0 degrees in the extending direction of the tongue B2) in the circumferential direction of the coil connected from the root of the tongue B2 to the tongue B2. When the insert B1 is inserted into the tap hole A2 by the insert insertion tool, the tongue B2 is positioned at the far side of the tap hole A2.

Figure 4:
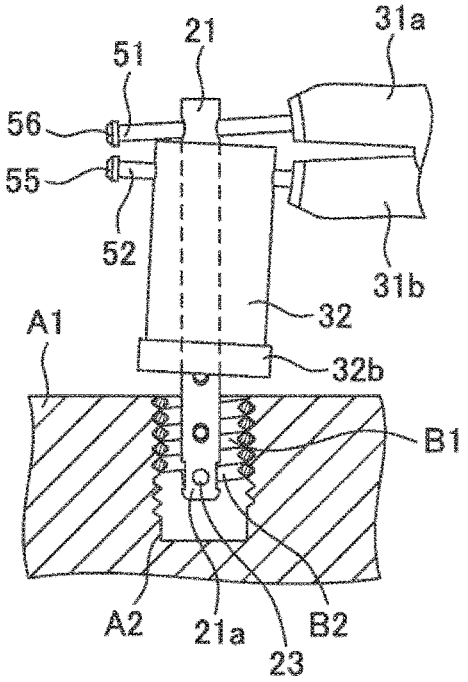
FIG. 4 is a first view for describing a tongue break-off operation according to the embodiment.

In the tongue break-off operation of breaking off the tongue B2, first, the grip unit, which is the rear end portion of the plier 31, is held by the user. The insertion member 20, that is, the hook member 21, is inserted into the tap hole A2 from above the tap hole A2. The inserted hook member 21 gradually descends, and as illustrated in FIG. 4, the tongue B2 enters the storage space between the hook member 21 and the guide member 22 (the space formed by the hook member 21 and the guide member 22). At this time, the tongue B2 abuts against the inclined surface M2 of the hook member 21 or the inclined surface M5 of the guide member 22 (refer to FIG. 3), and enters the storage space along the inclined surfaces M2 and M5. When the tongue B2 enters the storage space, the guide member 22 comes into contact with the tongue B2 entering the storage space to be elastically deformed.

The user who holds the grip unit of the plier 31 feels resistance when the tongue B2 passes between the hook member 21 and the guide member 22 (i.e., the entrance to the storage space), but after the tongue B2 passes through the entrance, the user does not feel resistance. Therefore, the user recognizes that the tongue B2 has entered the storage space and grasps that the grip unit of the plier 31 may be gripped. Meanwhile, even when the user does not recognize that the tongue B2 has entered the storage space as described above and continues to insert the insertion member 20, the tongue B2 that has entered the storage space abuts against the abutting surface M3 of the hook member 21. Therefore, the user feels the resistance and recognizes that the tongue B2 has entered the storage space and grasps that the grip unit of the plier 31 may be gripped.

Next, as illustrated in FIG. 4, the grip unit of the plier 31 is gripped by the user in a state where the tongue B2 is present in the storage space between the hook member 21 and the guide member 22. In response to this, each of the stays 31*a* and 31*b* of the plier 31 move in the direction in which the tip end portions 51 and 52 are separated from each other (opening direction). The regulation member 32 is lowered by moving the tip end portion 52 of the second stay 31*b* downward, and as illustrated in FIG. 5, the guard 32*b* of the regulation member 32 abuts against the surface of the workpiece A1. Accordingly, the vertical separation distance between the surface of the workpiece A1 and the plier 31 is fixed, and the downward movement of the tip end portion 52 of the second stay 31*b* is restricted. Therefore, the tip end portion 52 of the second stay 31*b* does not move downward, but the tip end portion 51 of the first stay 31*a* continues to move upward. The upward movement of the tip end portion 51 raises the hook member 21, and as illustrated in FIGS. 6 and 7, the hook 21*a* of the hook member 21 is pulled up while being hooked onto the tongue B2. The hook 21*a* is hooked onto the tongue B2 in a state where the longitudinal direction of the hooking surface M1 is along the extending direction of the tongue B2.

When the inclined surface M4 of the guide member 22 abuts against the tongue B2 when the hook member 21 is raised until the hook 21*a* is hooked onto the tongue B2 as described above (refer to FIG. 3), the hook member 21 moves while the inclined surface M4 is in contact with the tongue B2. Thus, the hooking surface M1 of the hook 21*a* is automatically guided under the tongue B2 and abuts against the tongue B2. Accordingly, the hook 21*a* is reliably hooked onto the tongue B2. The hook member 21 is capable of rotating around the axis of the tip end portion 51 of the first stay 31*a* as a rotation axis, and oscillating by the separation distance (play) between the tip end portion 52 of the second stay 31*b* and the inner surface of the through-hole H4.

Next, as illustrated in FIGS. 6 and 7, the hook member 21 in a state where the hook 21*a* is hooked onto the tongue B2 rises in the diagonal direction tilted by a predetermined angle (for example, a predetermined angle having a range of 7 degrees to 8 degrees) of the acute angle with respect to the extending direction of the tap hole A2. When each of the rear end portions 53 and 54 (refer to FIGS. 1 and 2), which is the grip unit of the plier 31, is closed, the upward movement of the tip end portion 51 of the first stay 31*a* is stopped and the movement of the hook member 21 is also stopped. While the hook member 21 is rising, the tongue B2 is broken off from the insert B1, and the broken-off tongue B2 is held by the holding member 23. The holding member 23 is provided to come into contact with the tongue B2 in a state where the hook 21*a* is hooked onto the tongue B2. After this, the tongue break-off tool 10 is lifted upward by the user, and as illustrated in FIG. 8, the hook member 21 is taken out from the tap hole A2. Finally, the tongue B2 held by the holding member 23 is removed from the holding member 23 by the user.

According to the tongue break-off operation, the user holds the grip of the plier 31 and inserts the insertion member 20 into the insert B1 in the tap hole A2 from the hook 21*a* side, and grips the grip of the plier 31. Accordingly, the tongue B2 is broken off from the insert B1. At this time, the broken-off tongue B2 is held by the holding member 23. Accordingly, the broken-off tongue B2 is collected by the tongue break-off tool 10. Therefore, it is possible to eliminate the work of collecting the broken-off tongue B2 from the tap hole A2 by using a tool such as tweezers as before, and thus, it is possible to improve the work efficiency. Because the tongue B2 is broken off and held by the tongue break-off tool 10, it is not necessary to replace the tool, the work is not interrupted by the tool replacement, and thus it is possible to improve work efficiency.

Because the hook 21*a* is hooked onto the tongue B2 and pulled up from the far side to the near side of the tap hole A2 in the diagonal direction diagonally intersecting the extending direction of the tap hole A2, compared to a case where the hook 21*a* is hooked onto the tongue B2 and is pulled up in parallel with the extending direction of the tap hole A2 from the far side to the near side of the tap hole A2, it is possible to reliably break off the tongue B2. It is experimentally confirmed in multiple tongues B2 that it is possible to break off the tongue B2, which is not capable of being broken off even when the hook 21*a* is pulled up in parallel with the extending direction of the tap hole A2, by pulling up the hook 21*a* in the diagonal direction.

The above-described inclination angle in the diagonal direction is, for example, a predetermined acute angle within an angle range of 7 degrees to 8 degrees with respect to the extending direction of the tap hole A2. When the hook 21*a* is hooked onto the tongue B2, a force is applied to the tongue B2 in the direction of the predetermined angle. The predetermined angle is set according to the diameter or height of the insert B1 (the length parallel to the extending direction of the tap hole A2). But, for example, in order to make it easy to break off the tongue B2, the angle is preferably within 20 degrees, and not only to make it easy to break off the tongue B2, but also to reduce the size of the regulation member 32, the angle is more preferably within 10 degrees.

Here, when the plier 31 is operated by the user in a state where the hook member 21 is not inserted into the tongue B2 inserted into the tap hole A2 (i.e., a state where the hook 21*a* is not hooked onto the tongue B2), the hook member 21 moves along a circle centered on a pivot 31*c*, that is, a curve, but the hook 21*a* also moves along the curve. The moving member 30 moves the hook member 21 to rotate around the pivot 31*c* as a rotation axis, in which the hook 21*a* intersects (for example, orthogonally) a surface parallel to the extending direction of the tap hole A2 and the extending direction of the tongue B2, in a state where the hook member 21 is not inserted into the tap hole A2.

The insertion member 20 and the regulation member 32 are formed so as to be detachably attached to the plier 31. Accordingly, it is possible to remove the insertion member 20 and the regulation member 32. Therefore, several types of regulation members or several types of insertion members are prepared, and for example, according to the diameter or height of the insert B1, it is possible to replace the regulation member 32 or the insertion member 20 with another type of regulation member or insertion member.

As described above, according to the embodiment, the hook member 21 having the hook 21*a* hooked onto the tongue B2 of the insert B1 inserted into the tap hole A2 is moved by the moving member 30 in the diagonal direction diagonally intersecting the extending direction of the tap hole A2 from the far side to the near side of the tap hole A2. The tongue B2 is broken off from the insert B1 inserted into the tap hole A2. The tongue B2 broken off from the insert B1 is held by the holding member 23. Therefore, it is possible to collect the broken-off tongue B2 by the tongue break-off tool 10, it is possible to eliminate the collection work of collecting the broken-off tongue B2 from the tap hole A2 by using a tool such as tweezers as before, and thus, it is possible to improve the work efficiency. It is possible to eliminate the need to replace the tool, the work is not interrupted by the replacement of the tool, and thus, it is possible to improve the work efficiency.

Modification Example of Insertion Member

Modification Examples 1 and 2 of the insertion member 20 will be described with reference to FIGS. 10 and 11.

Figure 10:
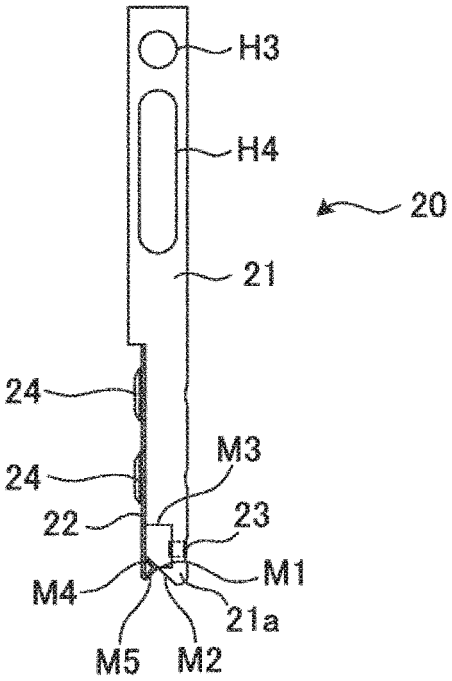
FIG. 10 is a view illustrating Modification Example 1 of an insertion member according to the embodiment.

In Modification Example 1, as illustrated in FIG. 10, the tip end portion of the guide member 22 is bent toward the hook member 21, and the bent tip end portion is formed in a V shape that protrudes and bends toward the hook member 21. The guide member 22 has two inclined surfaces M4 and M5 as described above. These inclined surfaces M4 and M5 are flat surfaces that are inclined so as to be away from each other from the bent part. The height position of the bent part is the same height position as the hooking surface M1 of the hook 21*a*. The tongue break-off operation is the same as described above.

Figure 11:
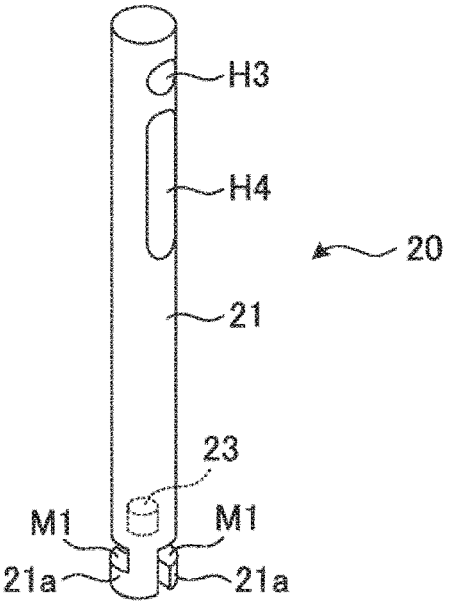
FIG. 11 is a view illustrating Modification Example 2 of an insertion member according to the embodiment.

In Modification Example 2, as illustrated in FIG. 11, the hook member 21 has two hooks 21*a*, the guide member 22 is absent, and the magnet, which is the holding member 23, is provided inside the lower end side of the hook member 21. The lower surface of the magnet is exposed from the hook member 21. Each of the hooks 21*a* is spaced apart such that the tongue B2 is capable of entering therebetween, and the tip ends are formed to face directions opposite to each other. The tongue B2 enters this separated space of the hooks 21*a*, the hook member 21 rotates around the center axis (the center axis parallel to the extending direction of the hook member 21) as a rotation axis, and each of the hooking surfaces M1 of each hook 21*a* faces the tongue B2. In this state, when the hook member 21 moves in the diagonal direction, each of the hooks 21*a* is hooked onto the tongue B2. When the hook member 21 further moves in the diagonal direction, the tongue B2 is broken off from the insert B1 and is attracted to and held by the magnet, which is the holding member 23.

Therefore, in the tongue break-off operation in Modification Example 2, in a state where the tongue B2 is positioned above each of the hooking surfaces M1 (the plier 31 side) between the hooks 21*a*, the user turns the plier 31 by 90 degrees within a flat surface, rotates the hook member 21 with the center axis as a rotating axis, and then grips the grip of the plier 31. The operations other than the operation of rotating the plier 31 within the flat surface are the same as the description above.

Here, for example, the insertion member 20 attached to the plier 31 may be replaced with another insertion member. In the replacement work of the insertion member 20, each of the return units 55 and 56 is removed from the plier 31, and the regulation member 32 and the insertion member 20 are removed from the plier 31. After this, for example, the insertion member 20 of Modification Example 1 or 2 is attached to the plier 31 together with the regulation member 32. Further, each of the return units 55 and 56 is attached to the plier 31. Accordingly, the replacement of the insertion member 20 is completed.

Other Embodiments

In the description above, an example is described in which a columnar member is used as the hook member 21, but the invention is not limited thereto. For example, it is possible to use members having various shapes such as a square columnar member. An example is described in which the hook member 21 is formed such that the longitudinal direction of the hooking surface M1 of the hook 21*a* is parallel to the extending direction of the first stay 31*a*, but the present invention is not limited thereto. For example, the hook member 21 may be formed such that the longitudinal direction of the hooking surface M1 of the hook 21*a* is tilted by a predetermined angle (for example, several degrees) in the axial direction (extending direction) of the hook member 21 with respect to the extending direction of the first stay 31*a*. The hook member 21 may be formed such that the longitudinal direction of the hooking surface M1 of the hook 21*a* is tilted by a predetermined angle (for example, 90 degrees or 45 degrees) around the axis of the hook member 21 with respect to the extending direction of the first stay 31*a*.

In the description above, an example is described in which a plate spring is used as the guide member 22, but the invention is not limited thereto. It is possible to use other members. As the shape of the guide member 22, an example is described in which the shape that guides the hooking surface M1 of the hook 21*a* to the tongue B2, for example, a V shape, is formed, but the invention is not limited thereto. It is possible to use various shapes. An example is described in which the guide member 22 is provided, but the invention is not limited thereto. The guide member 22 may not be provided. However, in order to reliably hook the hook 21*a* onto the tongue B2 of the insert B1 inserted into the tap hole A2, it is preferable to provide the guide member 22.

In the description above, an example is described in which a magnet that attracts the tongue B2 that was broken off from the insert B1 is used as the holding member 23, but the invention is not limited thereto. For example, an adhesive material may be used, or otherwise, the tongue B2 may be held by being pressed against the hook 21*a* by the guide member 22 before being broken off (held by being sandwiched between the guide member 22 and the hook 21*a*), and the tongue B2 may be held by being pressed against the hook 21*a* as it is even after being broken off. In this case, because the guide member 22 functions as a holding member, it is possible to eliminate the magnet that is the holding member 23, and simplify the configuration.

In the description above, an example is described in which the magnet that is the holding member 23 is positioned in the vicinity of the hooking surface M1 of the hook 21*a* (on the hooking surface M1 side at the extended part of the hook 21*a*) and is provided on the hook 21*a*, but the invention is not limited thereto. For example, the magnet may be provided in the hook 21*a* by being positioned on the abutting surface M3 side at the extended part of the hook 21*a*, or may be provided at the end portion on the lower end side of the hook member 21 to be embedded in the abutting surface M3, depending on the magnetic force range of the magnet.

In the description above, an example is described in which a sleeve is used as the regulation member 32, but the invention is not limited thereto. It is also possible to use other members or various shapes. When it is possible to determine the separation distance (for example, the vertical separation distance) between the surface of the workpiece A1 and the plier 31 by a tool or member other than the tongue break-off tool 10, it is also possible to eliminate the regulation member 32.

Although the above-described embodiments according to the invention have been described above, the above-described embodiments are examples and do not limit the scope of the invention. It is possible to change the above-described embodiments in various manners. For example, the configuration elements illustrated in the above-described embodiments may be omitted, replaced, or changed, and the configuration elements according to different embodiments may be combined as appropriate. The above-described embodiments or modifications thereof are included in the scope of the invention described in the claims and the equivalent scope thereof.

A list of reference signs used in the drawing figures is shown below.

10 tongue break-off tool
20 insertion member
21 hook member
21*a* hook
22 guide member
23 holding member
24 fixing member
30 moving member
31 plier
31*a* first stay
31*b* second stay
31*c* pivot
31*d* biasing member
32 regulation member
32*a* storage hole
32*b* guard
51 tip end portion
52 tip end portion
53 rear end portion
54 rear end portion

55 return unit
56 return unit
A1 workpiece
A2 tap hole
B1 insert
B2 tongue
B3 notch
H1 through-hole
H2 through-hole
H3 through-hole
H4 through-hole
M1 hooking surface
M2 inclined surface
M3 abutting surface
M4 inclined surface
M5 inclined surface

The invention claimed is:

1. A tongue break-off tool comprising:
a hook member configured to have a hook hooked onto a tongue of an insert that is inserted into a tap hole;
a moving member that automatically moves the hook member in a diagonal direction diagonally intersecting an extending direction of the tap hole from a far side to a near side of the tap hole to break off the tongue from the insert; and
a holding member that holds the tongue broken off from the insert.

2. The tongue break-off tool according to claim 1, wherein
the moving member moves the hook member such that the hook is hooked onto the tongue to pull up the tongue in the diagonal direction, and the tongue is broken off from the insert with a tongue.

3. The tongue break-off tool according to claim 2, wherein
the hook has a hooking surface that is hooked onto the tongue, and is formed to be hooked onto the tongue in a state where a longitudinal direction of the hooking surface is along an extending direction of the tongue.

4. The tongue break-off tool according to claim 2, further comprising:
a guide member guides the hook to the tongue such that the hook is hooked onto the tongue.

5. The tongue break-off tool according to claim 4, wherein
the guide member is provided on the hook member and forms a storage space into which the tongue enters in cooperation with the hook member.

6. The tongue break-off tool according to claim 5, wherein
the guide member is an elastically deformable plate spring, and
the plate spring elastically deforms by coming into contact with the tongue that enters the storage space.

7. The tongue break-off tool according to claim 2, wherein
the moving member includes
a plier that moves the hook member, and
a regulation member determines a separation distance between the plier and the tap hole.

8. The tongue break-off tool according to claim 7, wherein
the plier has a first stay and a second stay, and
the hook member moves in the diagonal direction by the first stay, and includes a first through-hole through which the first stay passes and which has a size that makes it possible for the hook member to move along the first stay, and a second through-hole through which the second stay passes and which has a size that makes it possible for the hook member to move without being hindered by the second stay.

9. The tongue break-off tool according to claim 1, wherein
the hook has a hooking surface that is hooked onto the tongue, and is formed to be hooked onto the tongue in a state where a longitudinal direction of the hooking surface is along an extending direction of the tongue.

10. The tongue break-off tool according to claim 9, wherein
the holding member is provided to be in contact with the tongue in a state where the hook is hooked onto the tongue.

11. The tongue break-off tool according to claim 10, further comprising:
a guide member guides the hook to the tongue such that the hook is hooked onto the tongue.

12. The tongue break-off tool according to claim 9, further comprising:
a guide member guides the hook to the tongue such that the hook is hooked onto the tongue.

13. The tongue break-off tool according to claim 9, wherein
the moving member includes
a plier that moves the hook member, and
a regulation member determines a separation distance between the plier and the tap hole.

14. The tongue break-off tool according to claim 1, wherein
the holding member is provided to be in contact with the tongue in a state where the hook is hooked onto the tongue.

15. The tongue break-off tool according to claim 1, further comprising:
a guide member guides the hook to the tongue such that the hook is hooked onto the tongue.

16. The tongue break-off tool according to claim 15, wherein
the guide member is provided on the hook member and forms a storage space into which the tongue enters in cooperation with the hook member.

17. The tongue break-off tool according to claim 16, wherein
the guide member is an elastically deformable plate spring, and
the plate spring elastically deforms by coming into contact with the tongue that enters the storage space.

18. The tongue break-off tool according to claim 1, wherein
the moving member includes
a plier that moves the hook member, and
a regulation member determines a separation distance between the plier and the tap hole.

19. The tongue break-off tool according to claim 18, wherein
the plier has a first stay and a second stay, and
the hook member moves in the diagonal direction by the first stay, and includes a first through-hole through which the first stay passes and which has a size that makes it possible for the hook member to move along the first stay, and a second through-hole through which the second stay passes and which has a size that makes it possible for the hook member to move without being hindered by the second stay.

20. A tongue break-off method comprising:
hooking a hook of a hook member included in a tongue break-off tool onto a tongue of an insert that is inserted into a tap hole;
moving the hook member automatically in a diagonal direction diagonally intersecting an extending direction of the tap hole from a far side to a near side of the tap hole to break off the tongue from the insert, by a moving member included in the tongue break-off tool; and holding the tongue broken off from the insert by a holding member included in the tongue break-off tool.

* * * * *